US006098210A

United States Patent [19]

Broden

[11] Patent Number: 6,098,210

[45] Date of Patent: Aug. 8, 2000

[54] URINE COLLECTING DEVICE

[76] Inventor: Bengt-Inge Broden, Gårdfarivagen 3, S-352 00 Skara, Sweden

[21] Appl. No.: 09/192,264

[22] Filed: Nov. 16, 1998

Related U.S. Application Data

[63] Continuation-in-part of application No. 08/750,970, Dec. 2, 1996, Pat. No. 5,842,233.

[30] Foreign Application Priority Data

Jun. 2, 1994 [SE] Sweden ..... 9401910

[51] Int. Cl.[7] ..... A47K 11/00

[52] U.S. Cl. ..... 4/144.1

[58] Field of Search ..... 4/144.1–144.4; 604/317, 323, 326, 350; 137/852

[56] References Cited

U.S. PATENT DOCUMENTS

| | | | |
|---|---|---|---|
| 3,473,172 | 10/1969 | Friedman | 4/144.3 |
| 3,781,922 | 1/1974 | Ericson | 604/317 X |
| 3,901,235 | 8/1975 | Patel | 604/323 |
| 5,010,599 | 4/1991 | Nilsson | 4/144.3 X |

FOREIGN PATENT DOCUMENTS

| | | |
|---|---|---|
| 2936622 | 3/1981 | Germany . |
| 378356 | 9/1975 | Sweden . |
| 448672 | 3/1987 | Sweden . |
| 880359 | 3/1990 | Sweden . |

*Primary Examiner*—Charles E. Phillips
*Attorney, Agent, or Firm*—Sughrue, Mion, Zinn, Macpeak & Seas, PLLC

[57] ABSTRACT

A device for collecting urine or other organic body fluids includes a flexible bag (1) made of liquid-impervious sheet material, a urine-receiving member (2) which receives and conducts urine into the bag, and a device which prevents urine from leaving the bag through the urine-receiving members. The urine-receiving member (2) is attached to a mounting flange (5) which is welded sealingly to the bag (1). The flange is provided with a bottom which lies at least partially loosely against the bag wall. The flange bottom includes openings through which urine can flow and that part of the bag wall located beneath the bottom is provided with at least one cut so as to form at least one flap. This flap allows urine to flow into the bag (1) through the openings in the flange bottom, but functions to close these openings when urine tends to flow in the reverse direction.

13 Claims, 3 Drawing Sheets

URINE COLLECTING DEVICE

This application is a continuation-in-part of Ser. No. 08/750,970 filed Dec. 2, 1996 now U.S. Pat. No. 5,842,233.

The present invention relates to a device for collecting urine or other organic body fluids, comprising a flexible bag made of liquid-impervious sheet material, means for receiving and conducting urine into the bag, and means for preventing urine from leaving the bag through the urine-receiving means.

A device of this kind eliminates, among other things, the various problems associated with the use of bottles and bedpans by patients confined to wheelchairs and beds. Furthermore, the device improves the hygiene of both patients and nursing personnel or minders, and many of the unpleasantnesses associated with the handling of bedpans can be eliminated, because the urine is handled while enclosed in a throw-away liquid-impervious plastic bag.

Urine-collecting devices of this kind can also be used by healthy people in many circumstances, for instance in automotive vehicles, boats and aircrafts.

U.S. Pat. No. 3,928,875 describes a urine-collecting device of this general kind. The manufacture of this known device, however, requires several working stages, among other things the fabrication of a separate valve housing with a loose float, therewith making manufacture relatively expensive.

The object of the present invention is to provide a urine-collecting device of the aforedefined kind which can be used by both men and women without the risk of spillage. The device shall also have a construction which enables the device to be manufactured in a very efficient manner and at low cost.

These objects are achieved in accordance with the invention by virtue of the coaction of a part of the wall of the bag with a mounting flange such as to obtain a check valve function.

An inventive urine-collecting device is characterized in that the urine-receiving means is attached to a mounting flange which is welded sealingly to the bag and which includes a bottom which lies at least partially loosely against the bag wall and which includes openings through which urine is able to pass; and in that the part of the bag wall which lies beneath said bottom has provided therein at least one cut such as to form at least one flap which while enabling urine to pass into the bag through the openings in said bottom, effectively closes these openings when urine tends to flow in the reverse direction.

A device of this kind can be readily manufactured since, among other things, it includes no separate valve housing and float, and can be fully automated.

According to one preferred embodiment of the invention, the bag wall has formed therein two flaps which are preferably generally semi-circular in shape and which face away from one another and are hingedly connected to an intermediate part of the bag material.

The urine-receiving device will conveniently be removably attached to the mounting flange, for instance through the medium of a bayonet fitting. This enables the urine-receiving device to be re-used after having first removed the urine-containing bag therefrom, whereafter the bag can be discarded.

According to one preferred embodiment of the urine-collecting device, the bag has a generally rectangular shape and the urine-receiving device is mounted at one short side of the bag. A part of the bag on the side of the receiving device opposite to said short side is welded by means of a transverse weld which joins the bag walls together. This prevents a heavy flow of urine against the flap from the interior of the bag, said flap functioning as a check valve, which further reduces the risk of urine leaking from the device.

The weld join will conveniently extend over a central part of the bag, such as to leave free urine passageways along both edge sides of the bag. The flaps are cut out of the bag wall such that one of said flaps is opened against the transverse weld join, meaning that urine is unable to flow directly towards the flap opening.

Other features of the invention will be apparent from the following Claims.

The invention will now be described in more detail with reference to an exemplifying embodiment thereof and also with reference to the accompanying drawings.

Figure 1:
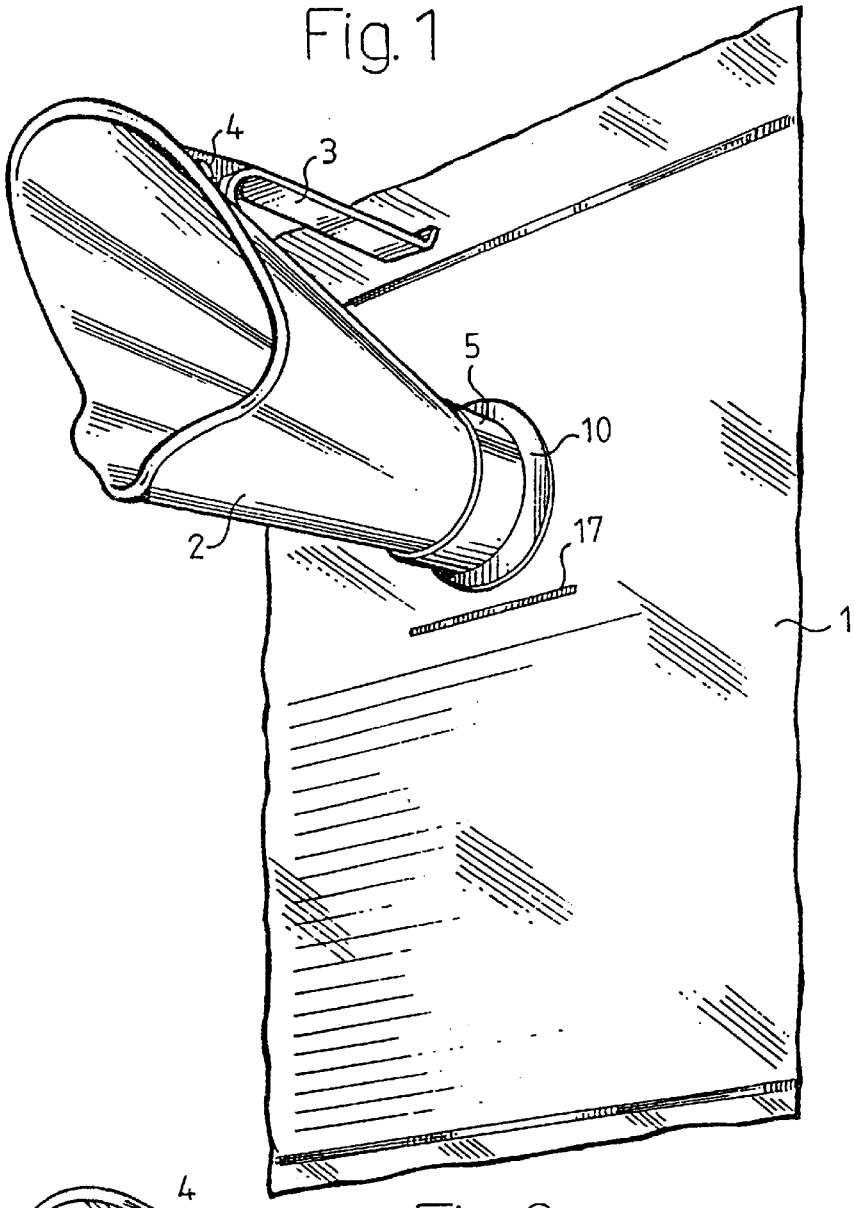
FIG. 1 is a perspective view of an inventive device.

The urine-collecting device shown in FIG. 1 includes a bag 1 comprised of liquid-impervious plastic sheet which has been folded appropriately and welded together. A funnel-shaped urine-receiving means 2 which functions to receive and conduct urine into the bag is fitted to one short side of the generally rectangular bag 1. This facilitates use of the bag even by bed-ridden patients. The outer contour line of the funnel is precisely configured to permit tight abutment with the skin when used by women. The front part of the funnel includes a handle 3, which facilitates pressing of the funnel against the skin of the user, to this end. The upper part of the handle 3 includes a hole 4 by means of which a used bag can be hung on a hook, located for instance adjacent the patient's bed.

Figure 2:
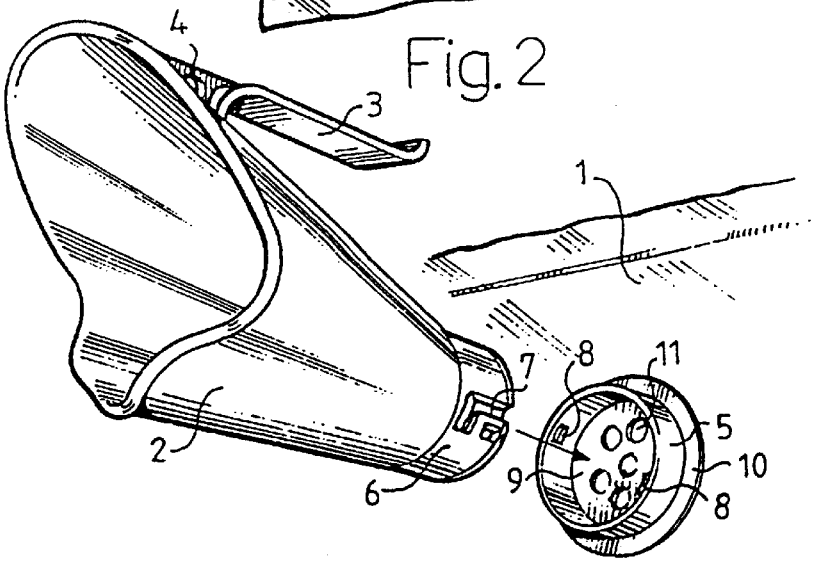
FIG. 2 illustrates fitting of the urine-receiving means to the urine-collecting bag.
Figure 6:
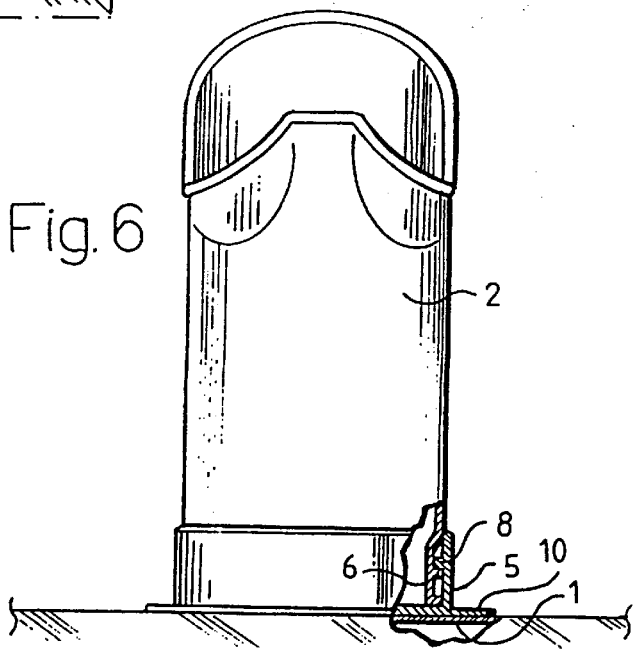
FIG. 6 is a side view of the device shown in FIG. 1, partially in section.

As shown in FIG. 2, the funnel 2 is fitted to the bag 1 with the aid of a mounting flange 5 welded to the bag. The bottom part 6 of the funnel includes two angled slots 7 which coact with corresponding projections 8 on the mounting flange to provide a bayonet lock by means of which the funnel can be secured to the flange. When fitting the funnel to the mounting flange, the bottom part 6 is therewith inserted into the flange 5 and the slots 7 and projections 8 brought into mutual coaction. The essentially horizontal parts of the slots 7 may be inclined to some extent, so that the funnel 2 will be pressed down when twisting the funnel so as to lock the funnel on the mounting flange. This results in an effective seal between the bottom edge surface of the part 6 and a bottom plate 9 provided in the flange 5; see also FIG. 6. With the intention of ensuring that the funnel will always be correctly positioned on the bag when fitted, the slots 7 on the lower part of the funnel may be given slightly different widths and arranged to coact with projections 8 of slightly different widths on the inner surface of the flange 5; see FIG. 4.

The mounting flange 5 is welded sealingly at the upper wall of the bag 1 through the medium of a circumferentially extending collar 10. The bottom plate 9 of the flange 5, on the other hand, lies loosely against the bag wall, and is provided with a number of openings 11 for the through-passage of urine.

Figure 3:
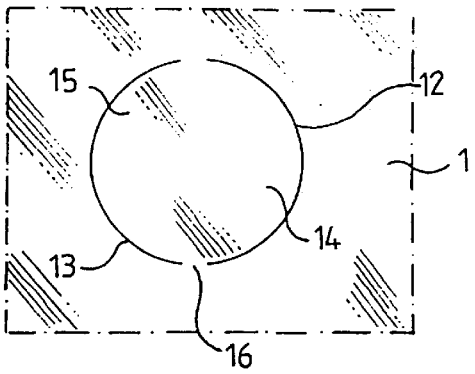
FIG. 3 shows part of a bag wall provided with flaps.
Figure 4:
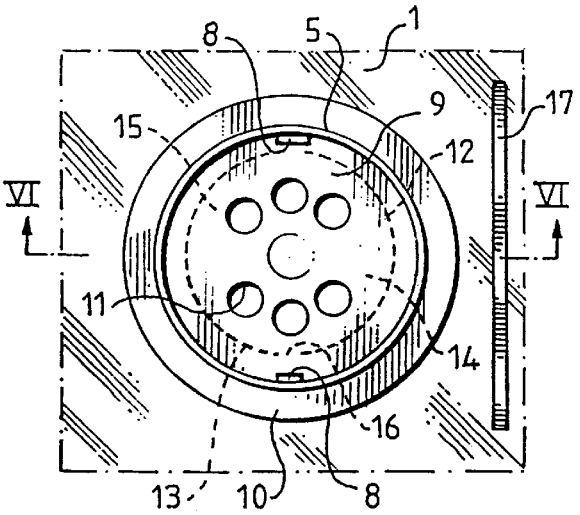
FIG. 4 illustrates part of the bag with a mounting flange fixedly welded thereto.

As will be seen from FIGS. 3 and 4, that part of the upper wall of the bag 1 which is located beneath the bottom plate 9 has provided therein two generally semi-circular cuts 12, 13 which form two flaps 14 and 15 in the bag material, these flaps being hinged together by an intermediate part 16 of the bag wall. As will be seen from FIG. 4, each flap is located beneath a series of openings 11 in the bottom plate 9 of the mounting flange 5, and is effective in preventing urine from running back through said openings.

Figure 5:
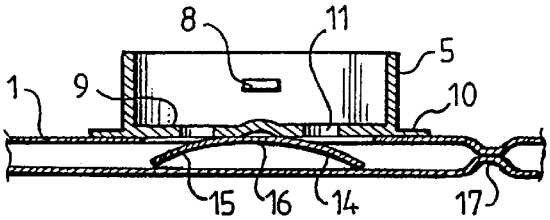
FIG. 5 is a sectional view taken on the line VI—VI in FIG. 4.

FIG. 5 is a sectional view which shows the positions of the flaps 14 and 15 when urine received in the funnel 2 flows down into the bag 1. The reference numeral 17 in FIGS. 1, 4 and 5 identifies a weld which joins together the two walls of the bag 1 across a part located centrally of the mounting flange 5. This weld prevents urine from flowing heavily from the bottom part of the bag directly towards the opening defined by the flap 14. Instead, the urine will flow in towards the flaps from the side on which the flaps are joined to the upper wall of the bag by the part 16. The flaps are therewith pressed sealingly against the perforated bottom plate 9 of the mounting flange 5 and close the openings. The flaps thus function as effective check valves.

When using an inventive urine-collecting device, urine is received in the funnel 2 and runs down into the bag 1 while flexing away the flaps 14 and 15 formed in the thin bag-material, as illustrated in FIG. 5. In the event of urine flowing back from the bag, the flaps are again swung up into contact with the plate and therewith close the openings 11, so that no urine is able to leave the bag.

When the bag has been filled with urine, for instance after having been used once or twice, the funnel 2 is disconnected from the bag, which can be effected easily. The bag may be provided with a tear line, to facilitate emptying of the bag. The bag is then discarded. All of the surfaces of the funnel 2 are smooth, so that the funnel can be easily cleaned and fitted to a new bag with a simple movement of the hand. Flaps that have mutually different degrees of flexibility can be provided, by varying the length of the cuts which form the flaps. The device may alternatively include only one single flap, in which case the flap opening is conveniently positioned towards the transverse weld 17. Another alternative is to punch a plurality of smaller flaps of any desired shape in the bag wall.

Figure 7:
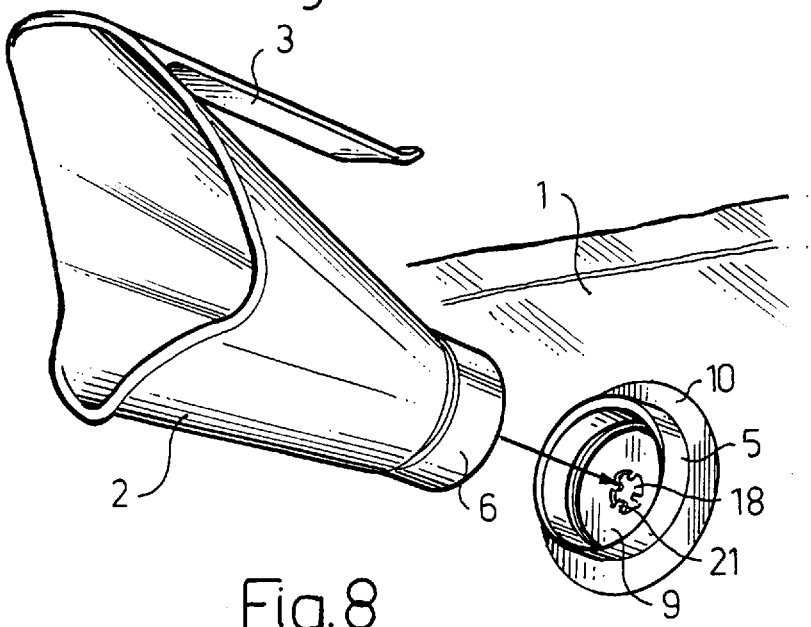
FIG. 7 is a perspective view of an other embodiment of the inventive device.
Figure 8:
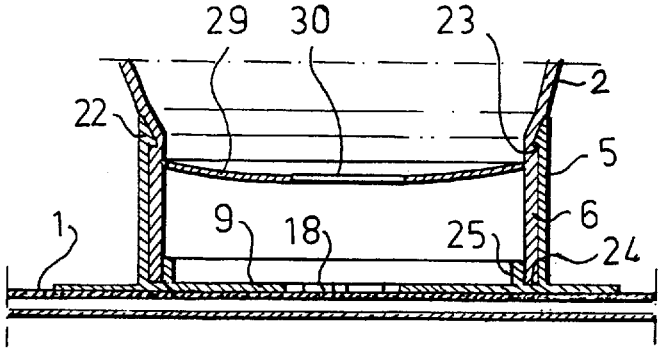
FIG. 8 is a sectional view through the lower part of the device of FIG. 7.
Figure 9:
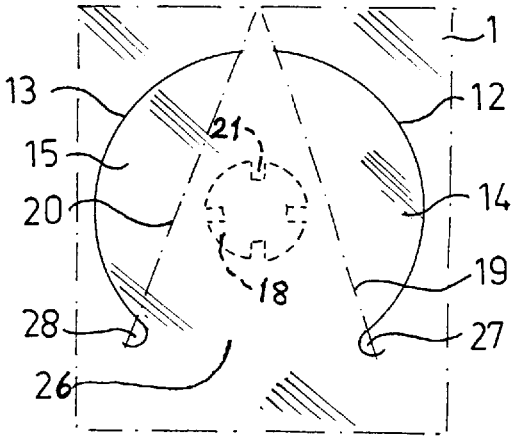
FIG. 9 shows part of the bag in FIG. 1 provided with flaps.

In FIGS. 7–9 a further embodiment of an inventive device is shown. In this embodiment the bottom plate 9 of the flange 5 is provided with a centre opening 18. This means that the flaps 14, 15 formed by the cuts 12, 13 in the upper wall of the bag 1, see FIG. 9, are each pressed against a continuous flat surface of the bottom plate 9, and that the opening 18 is covered by a continuous part of the bag wall as when the flaps are opened they are folded around the lines 19, 20 which do not cross the opening 18. This will greatly increase the sealing effect when liquid presses the bag wall against the bottom plate 9.

As shown in FIG. 9 the semi-circular cuts 12 and 13 are separated by a wider piece 26 of bag wall material at their lower ends than at their upper ends. This prevents urine flowing towards the flaps 14, 15 from the lower part of the bag from opening the flaps. Further, the lower parts 27, 28 of the cuts 12, 13 are turned outwards through an arcuate curve having a smaller radius of curvature than the main portions of the arcuate cuts. This has shown to improve the sealing effect of the flaps further.

The opening 18 is provided with bars 21 which project into the opening 18 from the edge thereof. These bars 21 prevent the bag wall from being pressed into the opening by the liquid in the bag.

FIG. 8 shows that the lower part 6 of the funnel 2 when inserted into the mounting flange 5 is locked in this position by means of an inwardly directed rim 22 which runs around the upper part of the mounting flange and a co-operating groove 23 in said lower part 6 of the funnel 2. The lower edge 24 of the part 6 is fit into the space between a rim 25 projecting upwardly from the bottom plate 9 and the surrounding flange 5. This means that a very good and reliable sealing effect is obtained between the lower part 6 of the funnel 2 and the flange 5 while allowing the funnel to be turned so that the user is able to grip the handle 3 in a convenient manner.

The lower part 6 of the funnel 2 is provided with a bottom 29 at a certain height above the lower edge 24 of said end part. This bottom 29 is provided with a centre opening 30 in line with the opening 18 in the bottom plate 9 of the flange 5. This renders it possible to take a sample of the urine collected in the bag by means of a pipette which is inserted through the openings 30 and 18.

Between the bottom 29 and the bottom plate 9 there is formed a space in which urine from the bag is collected which urine might pass the flaps if the bag is rapidly turned to one side. This urine will then pass back to the bag when the bag is reorientated. As shown in FIG. 8 the bottom 29 slopes towards the opening 30 to lead the urine collected by the funnel into the opening 30.

What is claimed is:

1. A device for collecting urine or other organic body fluids, comprising a flexible bag made of liquid-impervious sheet material and defining a lower part, means for receiving urine and conducting urine into the bag, and means for preventing urine from leaving the bag through said urine-receiving means, wherein the urine-receiving means is attached to a mounting flange which is welded sealingly to the bag and which is provided with a bottom the underneath surface of which is flat and lies at least partially loosely against the bag wall and which bottom includes an opening approximately at the center of the bottom for the through-passage of urine; said means for preventing comprising a wall part of the bag located beneath said bottom and which has provided therein at least one cut outside the opening provided in said bottom, said at least one cut being disposed so as not to open directly toward the lower part of the bag thereby to form at least one flap which while enabling urine to pass into the bag through said opening functions to close this opening when urine tends to flow back in the reverse direction by being pressed against the flat underneath surface of said bottom by the urine.

2. A device according to claim 1, wherein the opening in said bottom is provided with means for preventing the bag wall from being pressed into the opening by the urine collected in the bag.

3. A device for collecting urine or other organic body fluids, comprising a flexible bag made of liquid-impervious sheet material, means for receiving urine and conducting urine into the bag, and means for preventing urine from leaving the bag through said urine-receiving means, wherein the urine-receiving means is attached to a mounting flange which is welded sealingly to the bag and which is provided with a bottom the underneath surface of which is flat and lies at least partially loosely against the bag wall and which bottom includes an opening approximately at the center of the bottom for the through-passage of urine; said means for preventing comprising a wall part of the bag located beneath said bottom and which has provided therein at least one cut outside the opening provided in said bottom to form at least one flap which while enabling urine to pass into the bag through said opening functions to close this opening when urine tends to flow back in the reverse direction by being pressed against the flat underneath surface of said bottom by the urine, wherein the opening in said bottom is provided with short bars projecting into the opening from its edge, for preventing the bag wall from being pressed into the opening by the urine collected in the bag, wherein said means comprises short bars projecting into the opening from its edge.

4. A device for collecting urine or other organic body fluids, comprising a flexible bag made of liquid-impervious sheet material, means for receiving urine and conducting urine into the bag, and means for preventing urine from leaving the bag through said urine-receiving means, wherein the urine-receiving means is attached to a mounting flange which is welded sealingly to the bag and which is provided with a bottom the underneath surface of which is flat and lies at least partially loosely against the bag wall and which bottom includes an opening approximately at the center of the bottom for the through-passage of urine; said means for preventing comprising a wall part of the bag located beneath said bottom and which has provided therein at least one cut outside the opening provided in said bottom to form at least one flap which while enabling urine to pass into the bag through said opening functions to close this opening when urine tends to flow back in the reverse direction by being pressed against the flat underneath surface of said bottom by the urine, wherein said at least one cut comprises two arcuate cuts which run essentially parallel with the opening provided in the bottom of the mounting flange and on opposite sides of said opening, such that the bag wall has formed therein two flaps.

5. A device according to claim 4, wherein the bag has a generally rectangular shape; the urine-receiving means is mounted at one short side of the bag; and the two arcuate cuts are provided along the edges of the opening facing the long sides of the bag.

6. A device according to claim 5, wherein the arcuate cuts are separated by a wider piece of bag wall material on the side of said opening opposite to said short side of the bag than at the side of said opening facing said short side.

7. A device according to claim 6, wherein the end parts of the arcuate cuts which are separated by the wider piece of intermediate wall material are turned outwards through an arcuate curve having a smaller radius of curvature than the main portion of the arcuate cuts.

8. A device for collecting urine or other organic body fluids, comprising a flexible bag made of liquid-impervious sheet material, means for receiving urine and conducting urine into the bag, and means for preventing urine from leaving the bag through said urine-receiving means, wherein the urine-receiving means is attached to a mounting flange which is welded sealingly to the bag and which is provided with a bottom the underneath surface of which is flat and lies at least partially loosely against the bag wall and which bottom includes an opening approximately at the center of the bottom for the through-passage of urine; said means for preventing comprising a wall part of the bag located beneath said bottom and which has provided therein at least one cut outside the opening provided in said bottom to form at least one flap which while enabling urine to pass into the bag through said opening functions to close this opening when urine tends to flow back in the reverse direction by being pressed against the flat underneath surface of said bottom by the urine, wherein the urine-receiving means includes a part which is inserted into the mounting flange and sealingly locked therein while being rotatable in relation to the mounting flange.

9. A device according to claim 8, wherein an inwardly directed rim runs around the upper part of the mounting flange and a co-operating groove is formed around the part of the urine-receiving means insertable into said mounting flange.

10. A device according to claim 9, wherein an upwardly directed rim runs around the bottom of the mounting flange so that a narrow groove is formed between this rim and the mounting flange adapted to sealingly receive the lower edge of the part of the urine-receiving means insertable into the mounting flange.

11. A device for collecting urine or other organic body fluids, comprising a flexible bag made of liquid-impervious sheet material, means for receiving urine and conducting urine into the bag, and means for preventing urine from leaving the bag through said urine-receiving means, wherein the urine-receiving means is attached to a mounting flange which is welded sealingly to the bag and which is provided with a bottom the underneath surface of which is flat and lies at least partially loosely against the bag wall and which bottom includes an opening approximately at the center of the bottom for the through-passage of urine; said means for preventing comprising a wall part of the bag located beneath said bottom and which has provided therein at least one cut outside the opening provided in said bottom to form at least one flap which while enabling urine to pass into the bag through said opening functions to close this opening when urine tends to flow back in the reverse direction by being pressed against the flat underneath surface of said bottom by the urine, wherein the urine-receiving means includes a part which is inserted into the mounting flange and sealingly locked to the mounting flange, the part of the urine-receiving means insertable into the mounting flange having a bottom provided with an opening at a certain distance from the lower edge of said part so that a urine collecting chamber is formed between the bottoms of the urine-receiving means and the mounting flange, respectively.

12. A device according to claim 11, wherein the openings in said bottoms are essentially concentric, and the bottom in the urine-receiving means slopes towards the opening provided therein.

13. A device for collecting urine or other organic body fluids, comprising a flexible bag made of liquid-impervious sheet material and defining a lower part, a urine-receiving member which receives and conducts urine into the bag, and a check valve which prevents urine from leaving the bag through said urine-receiving member, wherein the urine-receiving member is attached to a mounting flange which is welded sealingly to the bag and which is provided with a bottom the underneath surface of which is flat and lies at least partially loosely against the bag wall and which bottom includes an opening approximately at the center of the bottom for the through-passage of urine; said check valve comprising a wall part of the bag located beneath said bottom and which has provided therein at least one cut outside the opening provided in said bottom, said at least one cut being disposed so as not to open directly toward the lower part of the bag thereby to form at least one flap which while enabling urine to pass into the bag through said opening functions to close this opening when urine tends to flow back in the reverse direction by being pressed against the flat underneath surface of said bottom by the urine.

* * * * *